US006164045A

United States Patent [19]

Focke et al.

[11] Patent Number: 6,164,045

[45] Date of Patent: Dec. 26, 2000

[54] DEVICE FOR PACKAGING GROUPS OF (INDIVIDUAL) PACKAGES

[75] Inventors: Heinz H. Focke, Verden; Hugo Mutschall, Kirchlinteln, both of Germany

[73] Assignee: Focke & Co. (GmbH & Co.), Verden, Germany

[21] Appl. No.: 09/312,850

[22] Filed: May 17, 1999

[30] Foreign Application Priority Data

May 18, 1998 [DE] Germany ..... 198 21 969

[51] Int. Cl.[7] ..... B65B 35/30

[52] U.S. Cl. ..... 53/543; 53/537; 53/500; 198/429

[58] Field of Search ..... 53/448, 496, 537, 53/538, 543, 498, 500; 198/418.5, 529, 430, 432, 433

[56] References Cited

U.S. PATENT DOCUMENTS

| | | | |
|---|---|---|---|
| 2,470,795 | 5/1949 | Socke . | |
| 2,681,171 | 6/1954 | Brown et al. | 53/496 |
| 2,834,167 | 5/1958 | Loveridge | 53/496 |
| 2,904,944 | 9/1959 | Notredame et al. | 53/496 |
| 3,046,712 | 7/1962 | Carter . | |
| 3,069,823 | 12/1962 | Schmid | 53/543 X |
| 3,250,371 | 5/1966 | Cella et al. . | |
| 3,273,304 | 9/1966 | Winter et al. | 53/496 |
| 3,327,450 | 6/1967 | Carter | 53/496 |
| 3,363,394 | 1/1968 | Rainbow | 53/496 |
| 3,593,488 | 7/1971 | Merkner . | |
| 3,659,726 | 5/1972 | Anderson | 53/537 X |
| 3,682,290 | 8/1972 | Von Gal et al. . | |
| 3,708,947 | 1/1973 | Green et al. . | |
| 3,914,921 | 10/1975 | Doran et al. | 53/543 |
| 3,984,964 | 10/1976 | Stoll | 53/543 X |
| 3,990,566 | 11/1976 | Nordgvist . | |
| 4,003,185 | 1/1977 | Goff | 53/543 X |
| 4,610,347 | 9/1986 | Inoko . | |
| 4,713,926 | 12/1987 | Mennie et al. . | |
| 4,843,797 | 7/1989 | Butterly et al. | 53/543 X |
| 4,942,720 | 7/1990 | Berney . | |
| 5,039,276 | 8/1991 | Leuvering . | |
| 5,133,446 | 7/1992 | Draghetti . | |
| 5,666,786 | 9/1997 | Fock et al. | 53/529 X |

FOREIGN PATENT DOCUMENTS

| | | |
|---|---|---|
| 174596 | 3/1986 | European Pat. Off. . |
| 277 844 | 8/1988 | European Pat. Off. . |
| 1 269 937 | 6/1968 | Germany . |
| 241 575 | 12/1986 | Germany . |
| 90 06 442 | 9/1990 | Germany . |
| 40 02 724 | 8/1991 | Germany . |
| 41 21 978 | 2/1992 | Germany . |
| 295 00 685 U | 5/1995 | Germany . |
| 197 00 150 | 7/1998 | Germany . |
| 914957 | 1/1963 | United Kingdom . |
| 1055611 | 1/1967 | United Kingdom . |

*Primary Examiner*—Daniel B. Moon
*Attorney, Agent, or Firm*—Sughrue, Mion, Zinn, Macpeak & Seas, PLLC

[57] ABSTRACT

Device for packaging groups, i.e. layers (14), of packages (10) in a carton (11) or the like, and individually arriving packages (10) are collected in the area of a grouping station (23) so as to form rows of packages (13), and the latter are pushed off in the transverse direction by a transverse slide (28) onto a collecting plate (29) in order to establish layers (14) comprising a plurality of rows of packages (13). The complete layers (14) are handled by a lifting conveyer (33) and delivered to the carton (11).

10 Claims, 7 Drawing Sheets

DEVICE FOR PACKAGING GROUPS OF (INDIVIDUAL) PACKAGES

BACKGROUND OF THE INVENTION

The invention relates to a device for packaging items, in particular squareshaped (individual) packages of approximately matching dimension in a shape or in a large container, in particular in a (dispatch) carton, and initially continuously delivered items form a row, and from a plurality of rows is formed a layer by transverse displacement of the rows, and the complete layer is handled by a lifting element and delivered to the shape or carton.

When packaging groups of individual items, in particular individual packages whilst forming an assembly composed of at least one layer of the individual packages or into a large volume carton, increasingly automatic, high output and reliable processing of the packaging stages is required. The (individual) packages are delivered by a production machine in irregular intervals, but they should be positioned within an assembly or within the carton in a sorted fashion, i.e. stacked in layers.

SUMMARY OF THE INVENTION

It is an object of the invention to offer a device which makes possible high output handling of (individual) packages, if appropriate of different size, for forming sorted assemblies or for filling cartons and which operates substantially automatically and faultfree.

To solve this object, the inventive device is characterised by the following features:

a) the items or (individual) packages are conveyed against a stop wall so as to form a row;

b) the row is reached over its full length by a transverse slide and deliverable in the transverse direction to a grouping station;

c) at the side opposite the transverse slide, the row(s) is/are supported by a counter slide;

d) the counter slide is movable with the rows which are moved in cycles for the purpose of forming a layer of items or packages, and the first formed row abuts the counter slide.

The invention is based on the knowledge that the group of (individual) packages, i.e. rows and layers formed of the latter, must be correctly positioned in order to ensure a fault-free transfer to the shape or blank for encasing the groups, or to the carton to be filled. The counter slide which co-acts with the transverse slide and lateral guide walls ensure that even in the event of high operating speed correct layers of sorted packages are established.

Guide or support walls for the (individual) packages are adjustable so that the device can be matched to processing of different packages. Furthermore, opto-electronic monitoring elements, in particular light barriers, which ensure faultfree processing of group formation and packaging, are positioned in selected areas.

BRIEF DESCRIPTION OF THE DRAWINGS

Further particularities of the invention will now be described in more detail, based on the patent drawings. Shown are, in FIG. 1: an operational illustration of the course of movement during filling of cartons, in a perspective illustration.

DETAILED DESCRIPTION OF THE INVENTION

Figure 1:
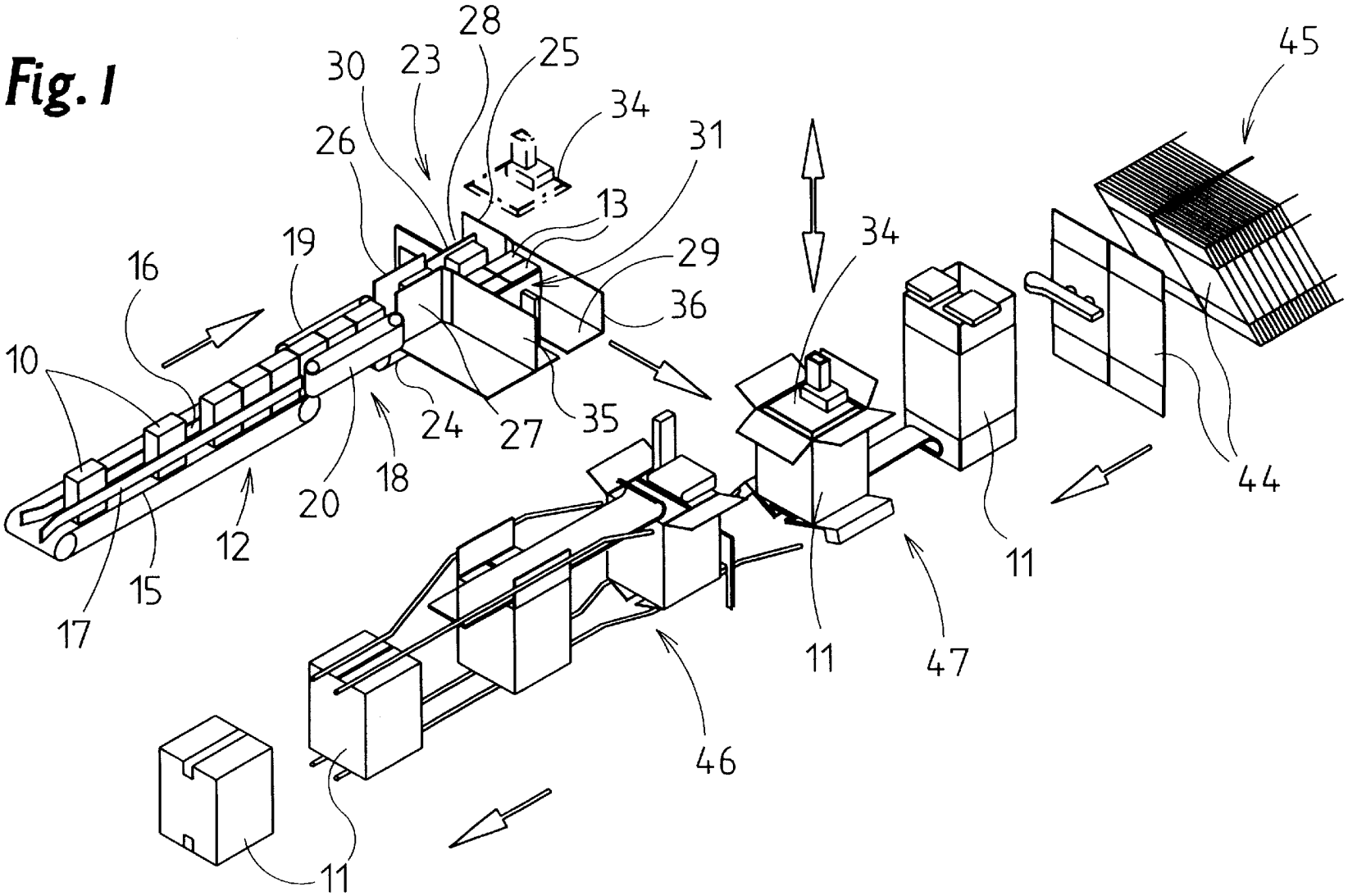

The device illustrated in the drawings deals with handling of squareshaped packages 10. They are mainly large volume soft packages, for example foil packages for cellulose products such as napkins, paper handkerchiefs, serviettes, etc.

In the given example, packages 10 are to be filled into a large volume carton 11. Analogous thereto, the device can also be used in the production of large assemblies, for example of one or more layers of packages 10 which are encased by a shape or blank serving as a sleeve.

Packages 10, for example coming from a manufacturing machine, are delivered on conveyer 12. Packages 10 are delivered as an individual row with irregular intervals. Initially, package rows 13 are formed from packages 10, and then layers 14 therefrom. Layer 14 is handled as a handling or packaging unit and delivered into upwardly open carton 11.

Conveyer 12 is composed of a conveyer belt 15 on which packages 10 are placed. Above conveyer belt 15 are configured lateral guides 16, 17 between which packages 10 are transported. Lateral guide 16 is adjustable transversely to the conveying direction so that conveyer 12 can be matched to packages 10 of different dimension, in particular different width.

Packages 10 arriving on conveyer 12 are not directly delivered by the latter to a grouping station 23 for forming package rows 13, but a conveying element is configured thereinbetween, i.e. an individualising belt 18 which is adjacent conveyer 12 as seen in the conveying direction. Individualising belt 18 takes into consideration the work process in the area of grouping station 23, i.e. transverse pushing off successively formed package rows 13. During delivery of the (three) packages 10 for a package row 13, individualising belt 18 is preferably driven at the same speed as conveyer 12 so that packages 10 enter grouping station 23, if appropriate, at different intervals. Whilst transversely pushing off a package row 13, delivery of further packages 10 to grouping station 23 has to be temporarily interrupted. For this purpose, individualising belt 18 is stopped so that no further packages 10 can exit on the side facing grouping station 23. During this phase, packages 10 are delivered by conveyer 12 so that a package queue or a tight row of packages 10 can develop at the entry side of individualising belt 18.

Individualising belt 18 is composed of two lateral belts 19, 20 positioned opposite each other which handle packages 10 on opposite sides by way of the suspended portion of the conveyer belt and stop them during an idle phase. The packages are slidingly conveyed on a stationary base 21. The suspended portions of the conveyer belt of lateral belts 19, 20 facing towards packages 10 are loaded in the meaning of being pressed onto packages 10 by sprung press-on elements 22. Lateral belt 19 is transversely adjustable for changing the distance between lateral belts 19, 20 for the purpose of matching to different packaging widths.

Individualising belt 18 successively releases individual packages 10. They are delivered to grouping station 23. In its area, individual package rows 13 are initially formed. For this purpose, packages 10 released by individualising belt 18 are conveyed by grouping belt 24, which is driven at a higher speed, against a stop, i.e. against stop wall 25 which extends transversely to the conveying direction. Grouping belt 24 extends from individualising belt 18 to an area the other side of stop wall 25. Packages 10 lie on an upper suspended portion of the conveyer belt of grouping belt 24. In a first conveying area downstream individualising belt 18, (individual) pages 10 are conveyed between lateral walls 26, 27 which ensure proper guidance of packages 10 in the area of grouping belt 24.

Row of packages 13, for example comprising three packages 10 formed by queuing on stop wall 25, is moved off in the transverse direction, i.e. by transverse slide 28 from grouping belt 24 to collecting plate 29. Transverse slide 28 comprises a slide plate 30 which is in its initial position placed in extension of the one side wall 26.

At the side of package row 13 opposite transverse slide 28 is a counter slide 31, also with slide plate 32. The latter extends in the initial position in extension of side wall 27.

Figure 7:
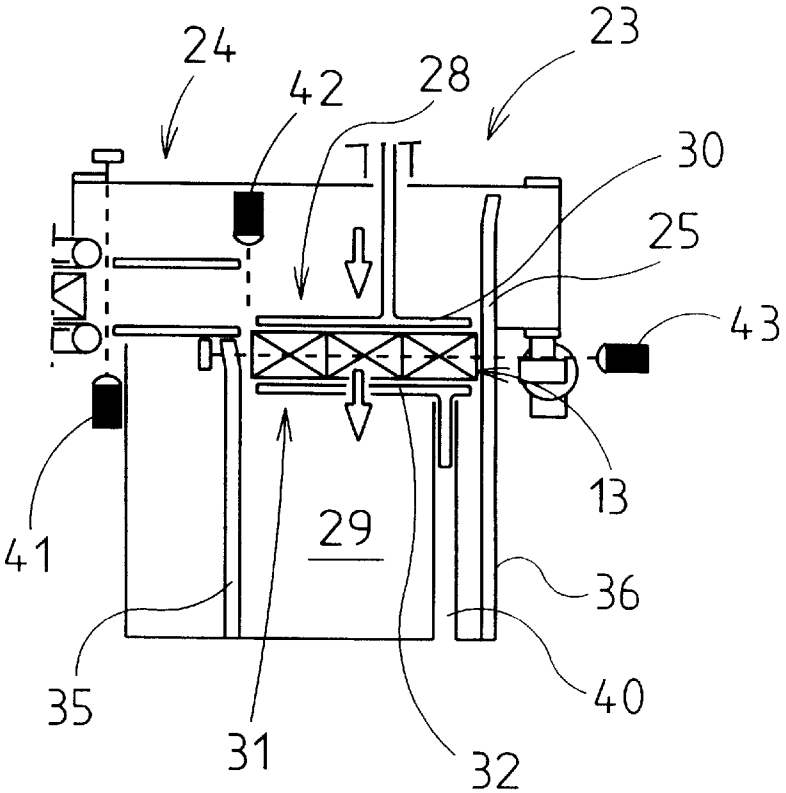
FIGS. 6 to 11: individual successive phases for forming a group or layer of individual packages, in a diagram.
Figure 6:
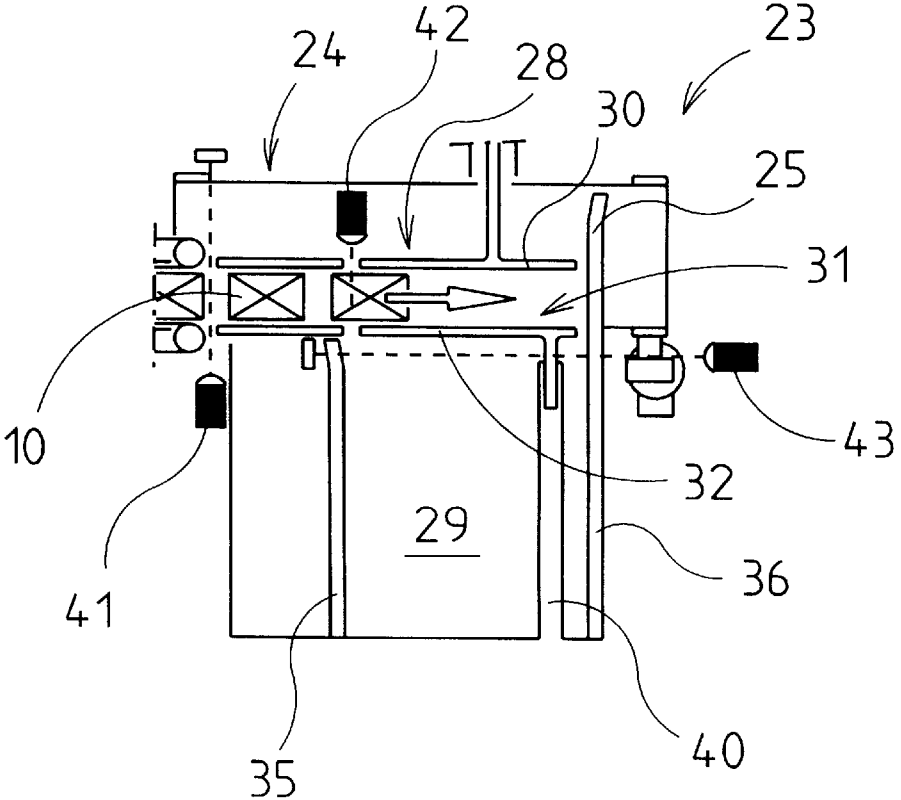
Figure 8:
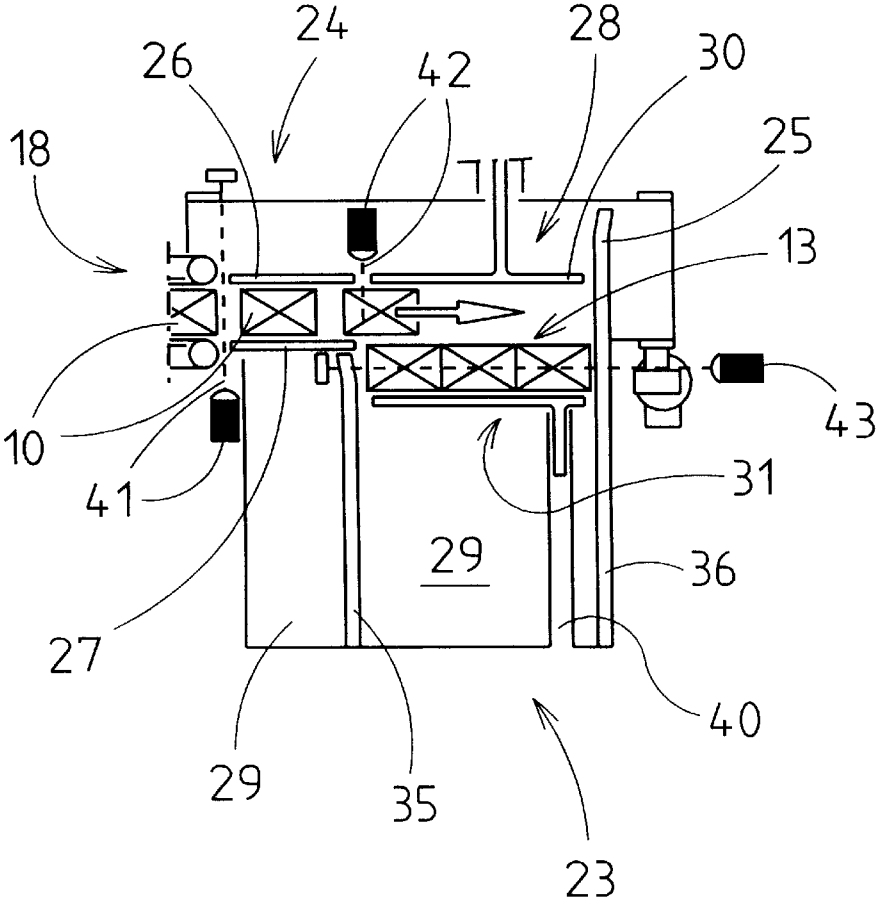

Slide plate 32 of counter slide 31 establishes in its initial position, i.e. when forming first package row 13, an continuation of lateral wall 27. A particularity lies in that counter slide 31 follows the move-off motion of transverse slide 28, thus offering a support to packages 10 or package row 13 when grouping belt 24 pushes it off and onto collecting plate 29. After having set down one or each package row 13 on collecting plate 29, counter slide 31 remains in this position as a stop or abutment for the first set down package row 13 (position as in FIG. 7 or as in FIG. 8). Transverse slide 28 always returns into its initial position (FIG. 8).

Figure 9:
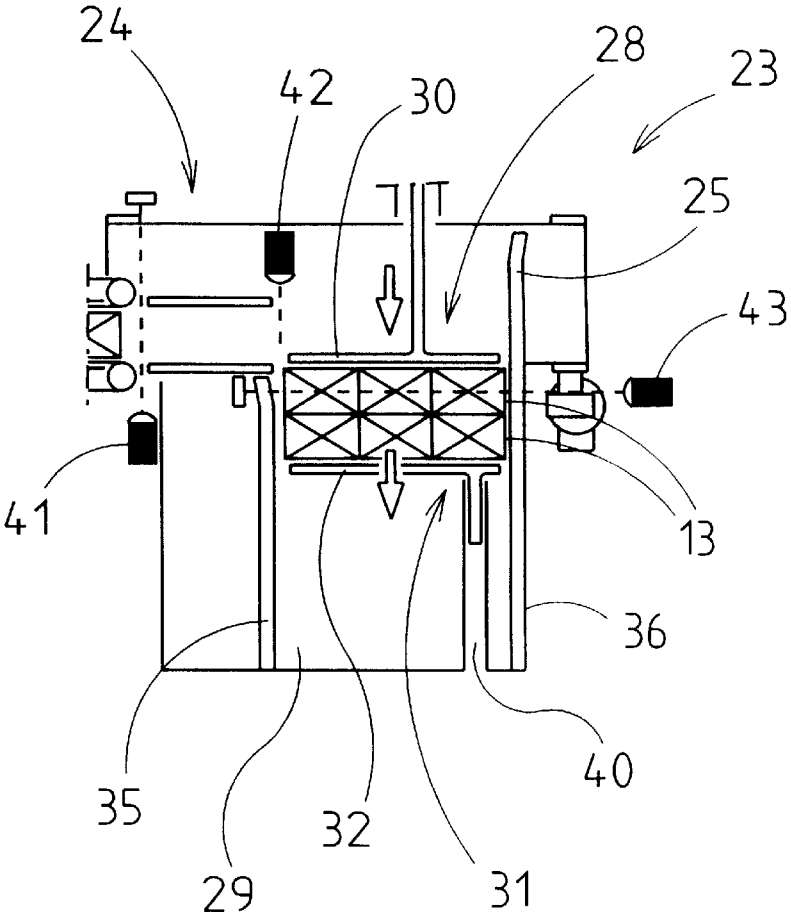
Figure 10:
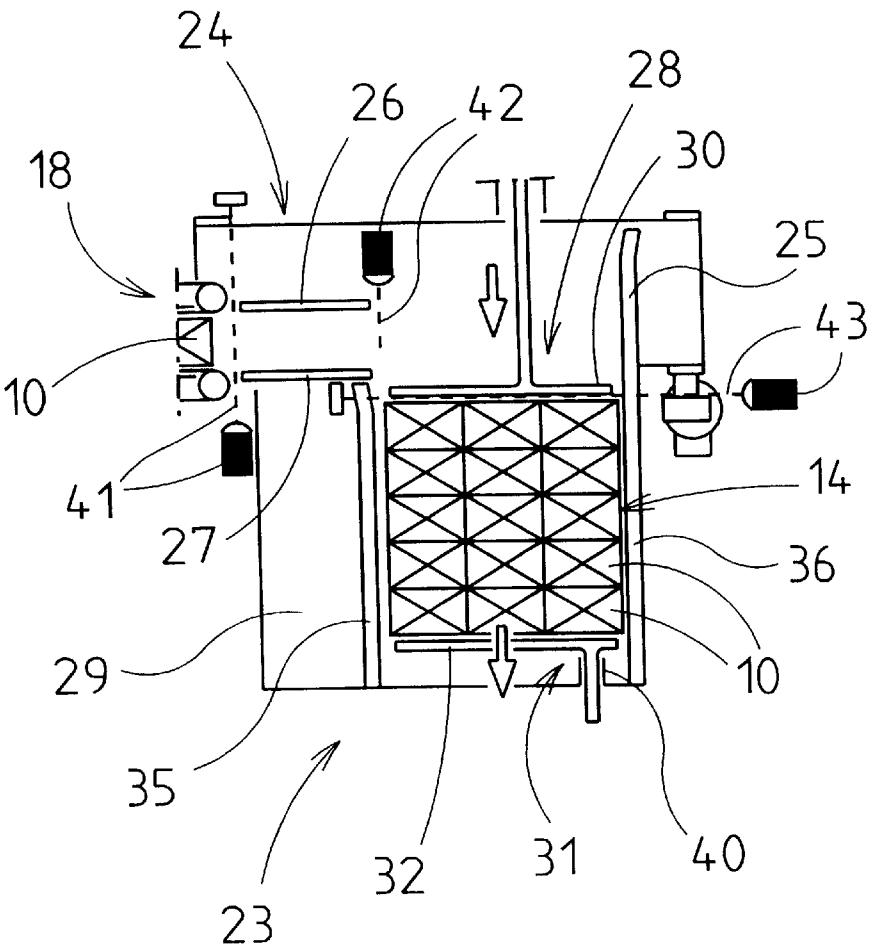

The next package rows 13 are formed as described on grouping belt 24 and one after the other deposited by transverse slide 28 in transverse direction on collecting plate 29. An already present package group or partial layer is then pushed on by a respective package row. Counter slide 31 follows this cycled movement whilst maintaining the function as support element for the initially pushed off package row 13 (FIG. 9, FIG. 10).

A package group formed of a plurality of package rows 13, i.e. layer 14, is handled at the top by a lifting conveyer 33, lifted off collecting plate 29 and delivered to a packaging station, in the present case inserted from the top into carton 11. Lifting conveyer 33 comprises an ascending and descending lifting head 34 which respectively handles a complete group of packages 10, i.e. a complete layer 14, by vacuum elements, lifts them up and inserts them from the top into carton 11. Lifting conveyer 33 can be of suitable design. Of advantage is a lifting conveyer which is in design and operating method according to 196 54 041.0.

On collecting plate 29, (partial) layers 14 and slidingly moved on in cycles by transverse slide 28. Lateral webs 35 and 36 are provided in the area of collecting plate 29 for the purpose of lateral support and guidance of packages 10. In the present exemplary embodiment, lateral web 36 and stop wall 25 are integrated into one unit.

The slides, i.e. transverse slide 28 and counter slide 31, are movable by means of linear drives 37, 38. They are arranged together with a drive motor below the movement level of packages 10. Linear drive 38 for counter slide 31, mounted below collecting plate 29, is via upright web 39 linked to counter slide 31. Web 39 passes through a slot 40 in collecting plate 29.

The area of grouping station 23 is also adaptable to different dimensions of packages 10 and/or package rows 13 as well as layers 14. For this purpose, side web 35 is transversely adjustable on a suitably dimensioned collecting plate 29. In the event of larger dimensions of packages 10 or layers 14, other elements are replaced by matching ones, for example lateral walls 26, 27 which, with corresponding dimension of package rows 13 to be established, can also be removed without being replaced. Equally, transverse slide 28 and counter slide 31 are matched to respective dimensions of package rows 13 or layer 14 by way of replacement; for practical reasons, only slide plates 30, 32 should be replaceable.

A further particularity lies in monitoring of the automatic movement flow of packages 10. For example, (individual) packages 10 exiting from the area of individualising belt 18 are counted, i.e. by a counting unit 41 which detects passing packages 10. In the present case, counting unit 41 consists of a light barrier which co-acts with a counting unit in the area of a central control. Counting unit 41 monitors completion of package rows.

An additional opto-electronic monitoring element, i.e. a light scanner 42, is configured adjustably in the area of grouping station 23, i.e. in such a manner that the correct end area of package row 13 is detected. In the event of slanted positioning of packaging 10 of package row 13, a signal is emitted by light scanner 42.

Figure 2:
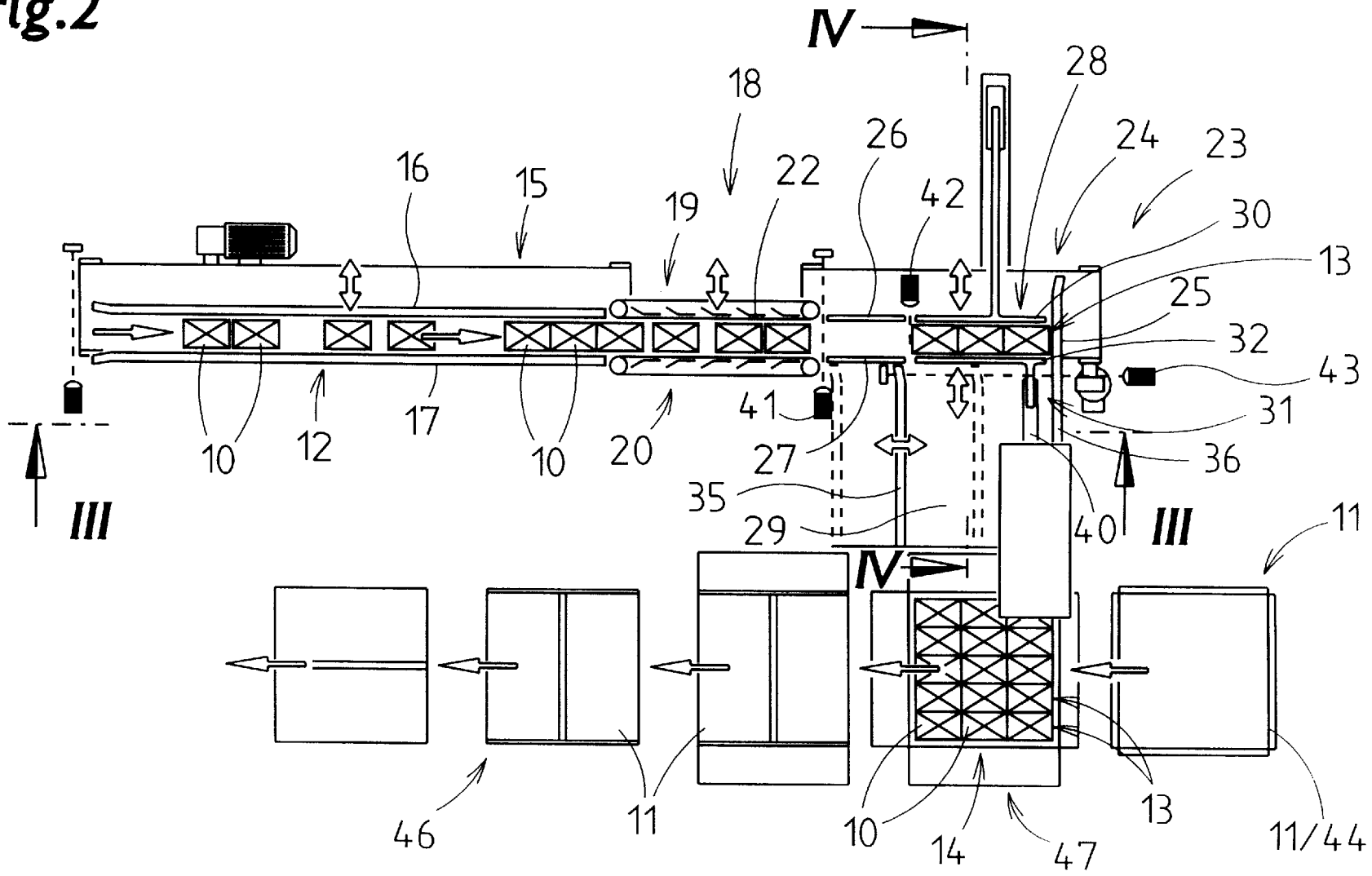
FIG. 2: the device for handling (individual) packages, in a simplified diagram.
Figure 3:
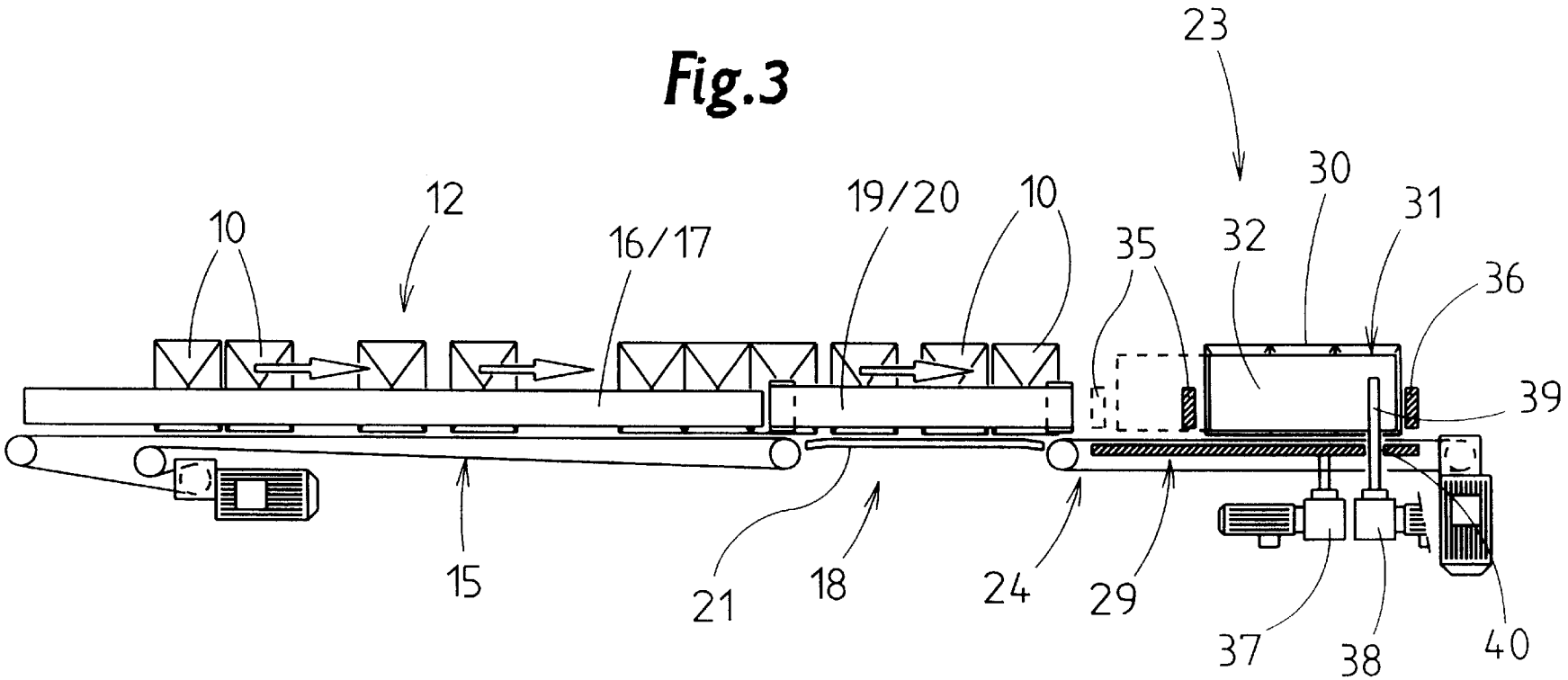
FIG. 3: a side view of a part of the device along the line III—III of FIG. 2.
Figure 4:
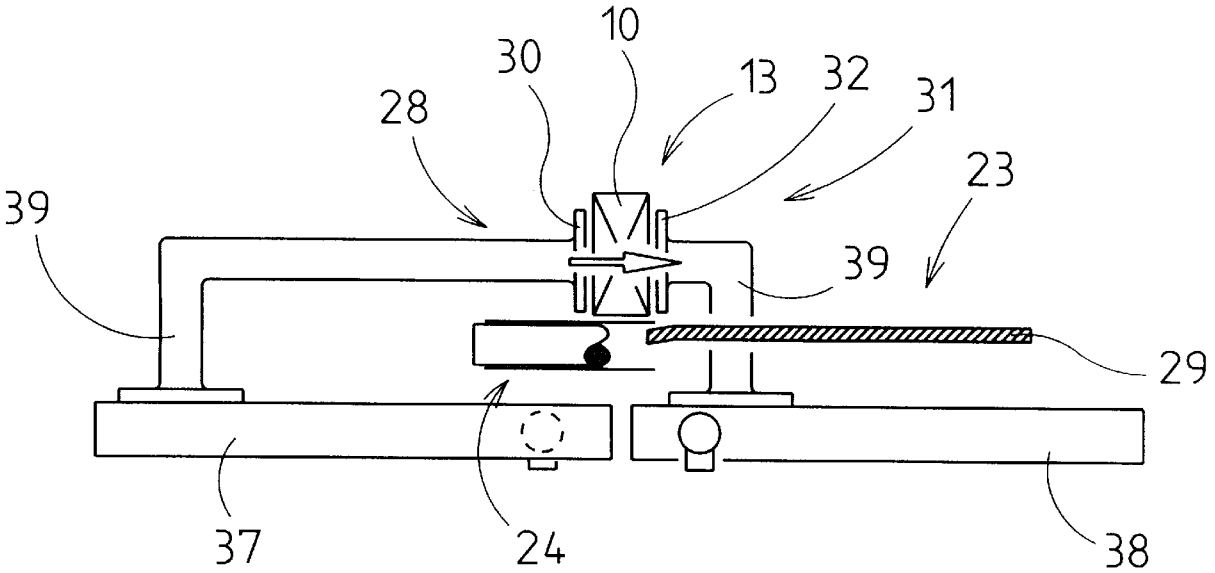
FIG. 4: a detail of the device along the line IV—IV of FIG. 2, at an enlarged scale, in a first position.
Figure 5:
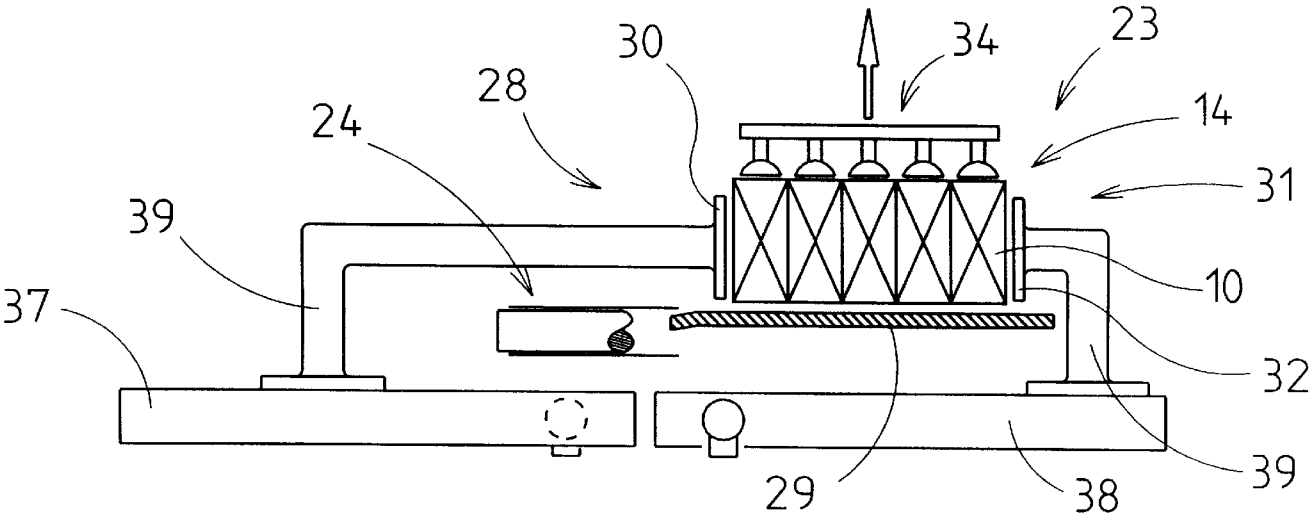
FIG. 5: a detail as in FIG. 4 after formation of a layer of individual packages.
Figure 11:
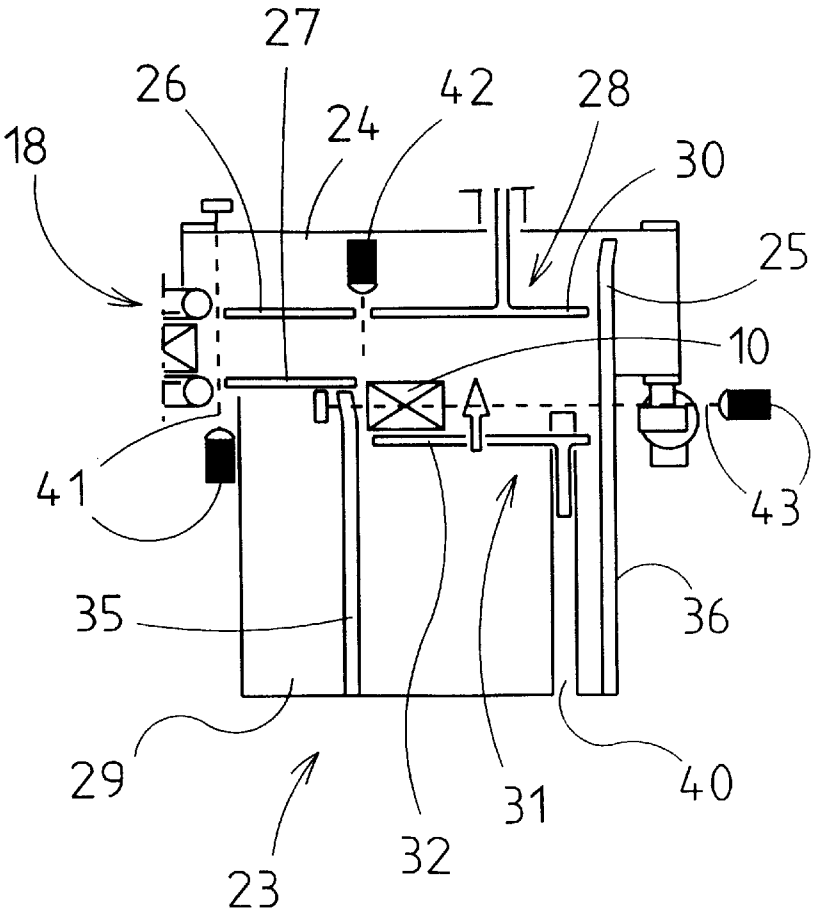

A monitoring unit, i.e. light barrier 43, is given a special task in the area of transition of grouping belt 24 to collecting plate 29. Light barrier 43, which is oriented transversely to the push direction of package rows 13, is to mainly determine if all packages 10 of one layer 14 have been received and moved away by lifting conveyer 33. After lifting off layer 14, counter slide 31 returns into the initial position as in FIG. 2. All packages 10 of a layer left behind on collecting plate 29 are then forcibly taken along and pushed in direction towards grouping belt 24. Individual packages 10 of this type then pass through light barrier 43 (FIG. 11). The device is switched off when finding package 10 left behind in this manner.

Cartons 11 or partially premanufactured carton shapes or blanks 44 are picked up from a shape magazine 45. Carton shapes or blanks 44 are then uprighted in such a manner that folding flaps for a bottom and end wall are oriented downwards or upwards. Uprighted carton 11 is conveyed along carton track 46 and in the area of delivery station 47, which is located in extension or continuation of collecting plate 29, is filled with packages 10. Thereafter, cartons 11 are in a conventional manner closed whilst being transported further.

List of Reference Numbers

10-Package
11-Carton
12-Conveyer
13-Row of Packages
14-Layer
15-Conveyer Belt
16-Lateral Guide
17-Lateral Guide
18-Individualising Belt
19-Lateral Belt
20-Lateral Belt
21-Base
22-Press-on Element
23-Grouping Station
24-Grouping Belt

25-Stop Wall
26-Side Wall
27-Side Wall
28-Transverse Slide
29-Collecting Plate
30-Slide Plate
31-Counter Slide
32-Slide Plate
33-Lifting Conveyer
34-Lifting Head
35-Lateral Web
36-Lateral Web
37-Linear Drive
38-Linear Drive
39-Web
40-Slot
31-Counting Unit
42-Light Probe
43-Light Barrier
44-Carton Shape
45-Shape Magazine
46-Length of Carton
47-Delivery Station

What is claimed is:

1. A device for packaging packages (10), of approximately matching dimensions, in a blank or in a large container (11), the packages being continuously fed first to form, in a grouping station (23), a row (13) of the packages, and then to form, from a plurality of rows (13) of packages, a layer (14) by means of transverse displacement of the rows (13) of packages, and wherein a complete layer (14) is gripped and introduced into the container or fed to the blank, said device comprising:

a) an individualizing belt (18) for conveying the packages individually and one after the other in a horizontal conveying direction into a grouping station (23) and onto a grouping belt (24) arranged and conveying in continuation of the individualizing belt (18);

b) arranged in the grouping station (23), an upright stop wall (25) which extends transversely to the conveying direction of the individualizing belt (18) and which limits a conveying path of the packages on the grouping belt (24), c) the packages (10) being conveyed individually and successively by the grouping belt (24) toward the stop wall (25) while forming the rows of packages (13), with a first package of each row (13) coming to rest on the stop wall (25), and other packages of the same row coming to rest on each other;

d) arranged in the grouping station (23), a transverse slide (28) which has a slide plate (30) extending along a full length of each row (13) of packages, and with which each row (13) of packs is pushed off in a transverse direction, parallel to the stop wall (25), from the grouping belt (24) and onto a collecting plate (29);

e) means for stopping the individualizing belt (18) when the row (13) is pushed by the transverse slide (28), so that no further packages (10) can be conveyed in the direction of the stop wall (25) and onto the grouping belt (24);

f) arranged in the grouping station, a counter slide (31) located transversely opposite to the transverse slide (28); and g) means for causing, as soon as a row (13) is formed which extends along the length of the slide plate (30), the transverse slide (28) to push the row along the stop wall (25) and onto the collecting plate (29) by a width of one package or more, wherein h) the layer (14) is formed on the collecting plate (29) as a plurality of the rows (13) and is pushed off, and i) when each row (13) is pushed off, the counter slide (31) abuts on a respective front row (13) of the layer (14) to be formed and supports the front row.

2. The device according to claim 1, further comprising: a supply conveyor (12) which follows the individualizing belt (18); means for guiding the packages (10) through the supply conveyor (12) in irregular succession; and means for controlling the individualizing belt (18) so that the packages (10) are queued at an end of the supply conveyor (12) and conveyed into the grouping station (23).

3. The device according to claim 1, wherein the individualizing belt (18) has two mutually opposite lateral belts (19, 20) between which the packages (10) are conveyed into the grouping station (23), wherein the lateral belts (19, 20) in the grouping station (23) are followed by two side walls (26, 27) so that the packages (10) are guided laterally as they enter the grouping station (23), wherein one (26) of the side walls is followed by the slide plate (30) of the transverse slide (28), and the other side wall (27) is followed by a slide plate (32) of the counter slide (31).

4. The device according to claim 1, further comprising upright lateral webs (35, 36), in a region of the collecting plate (29), which extend in the direction of movement of the transverse slide (28) and counter slide (31) and which support respective outer packages of the rows (13) during formation of the layer (14), one of the upright lateral webs (36) being an extension of the stop wall (25).

5. The device according to claim 1, further comprising:

for operation of the counter slide (31), a linear drive (38) located below a conveying plane of the collecting plate (29); and an upright web (39) linking the linear drive (38) to the counter slide (31), wherein the collecting plate (29) has a slot (40), parallel to the sliding direction of the counter slide (31), through which the web (39) passes and along which the web (39) is moved in order to move the counter slide (31).

6. The device according to claim 1, further comprising:

for operation of the transverse slide (28), a linear drive (37) which is arranged below a conveying plane of the collecting plate (29); and an upright web linking the linear drive (37) to the transverse slide (28).

7. The device according to claim 1, further comprising, in a region of transition between individualizing belt (18) and grouping station (23), a counting unit (41) for counting the packages (10) delivered to the grouping station (23).

8. The device according to claim 1, further comprising, in a region of the grouping belt (24) at an end of a formed row of packages (13), a test unit (42) which senses a position of a rear end surface of the last delivered package of the row of packages (13) and, based on the position, determines correct positioning of the packages of the row (13) of packages.

9. The device according to claim 1, further comprising, above the collecting plate (29), a lifting conveyor (33) which has a lifting head (34), and by which the layer (14) is gripped on a top side thereof, lifted and then either put into the container or fed to the blank.

10. The device according to claim 9, further comprising a light barrier (43) in a region of transition from the grouping belt (24) to the collecting plate (29), wherein, after a complete layer (14) has been pushed off onto the collecting plate (29) and the counter slide (31) has been returned to an initial position prior to abutment onto the first layer of a following row of packages, the light barrier (43) is operative to detect any packages not taken up by the lifting conveyor (33).

* * * * *